United States Patent [19]

Frisbee

[11] 3,933,207

[45] Jan. 20, 1976

[54] PIVOT BALL ASSEMBLY

[75] Inventor: Claude M. Frisbee, Bettendorf, Iowa

[73] Assignee: J. I. Case Company, Racine, Wis.

[22] Filed: Sept. 30, 1974

[21] Appl. No.: 510,293

[52] U.S. Cl. ..... 172/804; 308/236

[51] Int. Cl.[2] ..... E02F 3/76

[58] Field of Search ..... 172/801, 802, 803, 804, 172/805, 806, 807, 808, 809; 308/236

[56] References Cited

UNITED STATES PATENTS

| | | | |
|---|---|---|---|
| 3,238,647 | 3/1966 | Hall et al. | 172/801 |
| 3,645,340 | 2/1972 | Frisbee | 172/804 |

FOREIGN PATENTS OR APPLICATIONS

| | | | |
|---|---|---|---|
| 333,736 | 8/1930 | United Kingdom | 308/236 |

*Primary Examiner*—Richard C. Pinkham
*Assistant Examiner*—R. T. Stouffer
*Attorney, Agent, or Firm*—Arthur J. Hansmann

[57] ABSTRACT

A pivot ball assembly for use in swivelly attaching a bulldozer blade to a support arm, and the assembly includes an inner race member and an outer race member. The support arm receives the assembly and restricts the movement of the outer race member, and a retainer ring is supported on the support arm and engages the outer race member and is held to the support arm by screws. Extending through the center of the inner race member and the outer race member is a bolt, which bolt is secured in place by a nut mounted on one end thereof. Spacers are provides around the ends of the bolt to prevent excessive tightening thereof.

1 Claim, 2 Drawing Figures

PIVOT BALL ASSEMBLY

This invention relates to a pivot ball assembly, and, more particularly, it relates to a pivot ball assembly for use in swivelly attaching a bulldozer blade to a support arm.

BACKGROUND OF THE INVENTION

The prior art is already well developed with regard to the employment of bulldozer blades movably mounted on tractors. That type of prior art machine is widely used in bulldozing earth and other materials during construction, maintenance, and like work. U.S. Pat. No. 3,645,340 shows one example of the mounting of a bulldozer blade on a tractor.

In present day designing and building of tractors with bulldozer blades, one of the problems is providing a connector which suitably attaches the blade to the tractor such that the blade will have an articulate connection relative to the tractor, and this connection is the one which is located immediately behind the blade itself. That is, industry is concerned with mounting a bulldozer blade so that the blade can be movable relative to the support arm or like members extending from the tractor, and thus the blade can be tilted and pitched so that it is properly oriented relative to the ground or the material that it is working upon. Again, U.S. Pat. No. 3,645,340 shows an articulate type of connection for the blade, and such showing is particularly found in FIGS. 4, 5 and 6 of said patent. In that patent, the articulate mounting for the blade includes a swivel type of ball and socket assembly, and that assembly is shown to be secured in position by means of a snap ring which has one portion engaging the assembly and which has another portion disposed in a snap ring groove, all so that the assembly is held in a position at least as far as the arrangement in U.S. Pat. No. 3,645,340 is concerned. However, it has been found that the snap ring and groove type of restraining member for the swivel assembly mentioned is inadequate for the purpose desired. That is, in the prior art, the pivot ball bushing is retained in the support member or housing with a shoulder on the housing at one end of the bushing and with a snap ring at the other end of the bushing, as shown in said patent, and the requirements for the assembly are such that the snap ring does not always stay in its position in the groove, and thus the assembly is not secure. Further, the prior art retainer ring assembly commonly has the retainer ring move out of the groove and damage either the groove or the ring, in the process, and then reassembling the two never results in the desired tight assembly.

Accordingly, it is a general object of this invention to provide a pivot ball assembly for use in swivelly attaching a bulldozer blade to a support arm in a secure manner, and in a manner wherein the parts can be readily and easily manufactured, replaced as necessary, and reassembled, all for effecting a tight and snug assembly.

Another object of this invention is to provide a pivot ball assembly for use in swivelly attaching a bulldozer blade, whereby the assembly can be readily and easily manufactured and can be readily and easily disassembled and again assembled, all without damaging the parts and without resulting in any loose or weak assembly. Further, the present invention accomplishes the aforementioned objectives and it does so without requiring a complete structural change from the basic prior art assemblies wherein a support arm or member extends from the tractor and supports the assembly which in turn is connected with the back of the bulldozer blade. That is, only the pivot ball assembly itself is modified for achieving the present invention, and the attending members or adjacent elements of the overall assembly need not be altered in order to accommodate the improved pivot ball assembly of this invention.

Still further, where the prior art utilized a retainer ring in a groove, there was inherent end play in the arrangement, and thus the assembly could not be fully secure, and this condition was further exaggerated when the ring was dislodged or intentionally removed from the groove and then reassembled, and such looseness was inherent in the manufacturing practices and the required manufacturing tolerances between the parts. However, the present invention provides a pivot ball assembly wherein the parts can be fully secured in snug contact with each other, and further the parts can be readily disassembled and even replaced, and the subsequent assembly will result in a tight fit of all the parts. Still further, with the present invention as described herein, the pivot ball assembly provides for a greatly simplified machining and assembly process, and the close tolerances heretofore required and the difficult assembly process heretofore required are no longer required with the present invention.

Other objects and advantages will become apparent upon reading the following description in light of the accompanying drawings.

DETAILED DESCRIPTION OF THE PREFERRED EMBODIMENT

Figure 1:
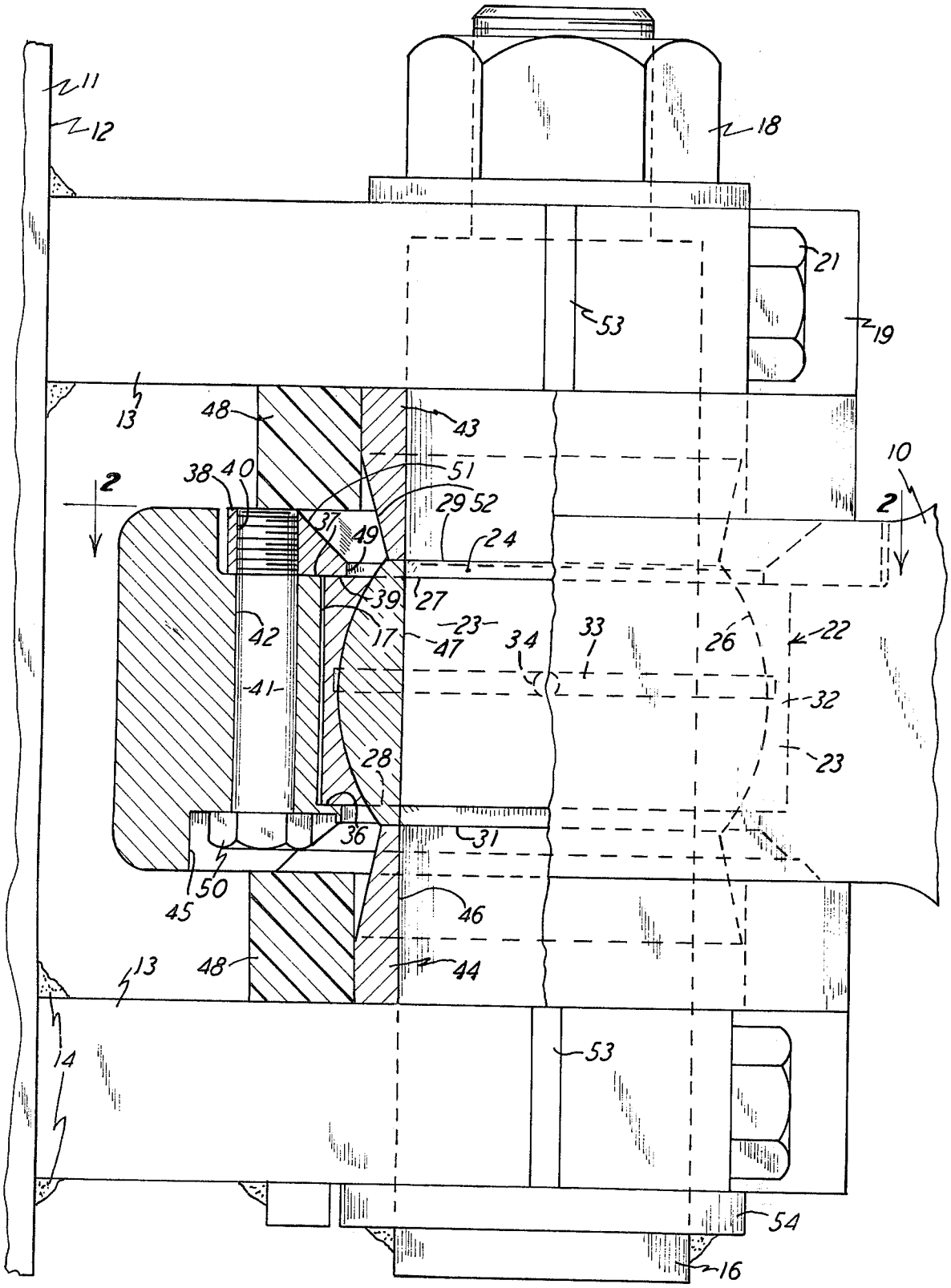
FIG. 1 is a view of a pivot ball assembly of this invention, with the view being partly in section and taken along the line 1—1 of FIG. 2.
Figure 2:
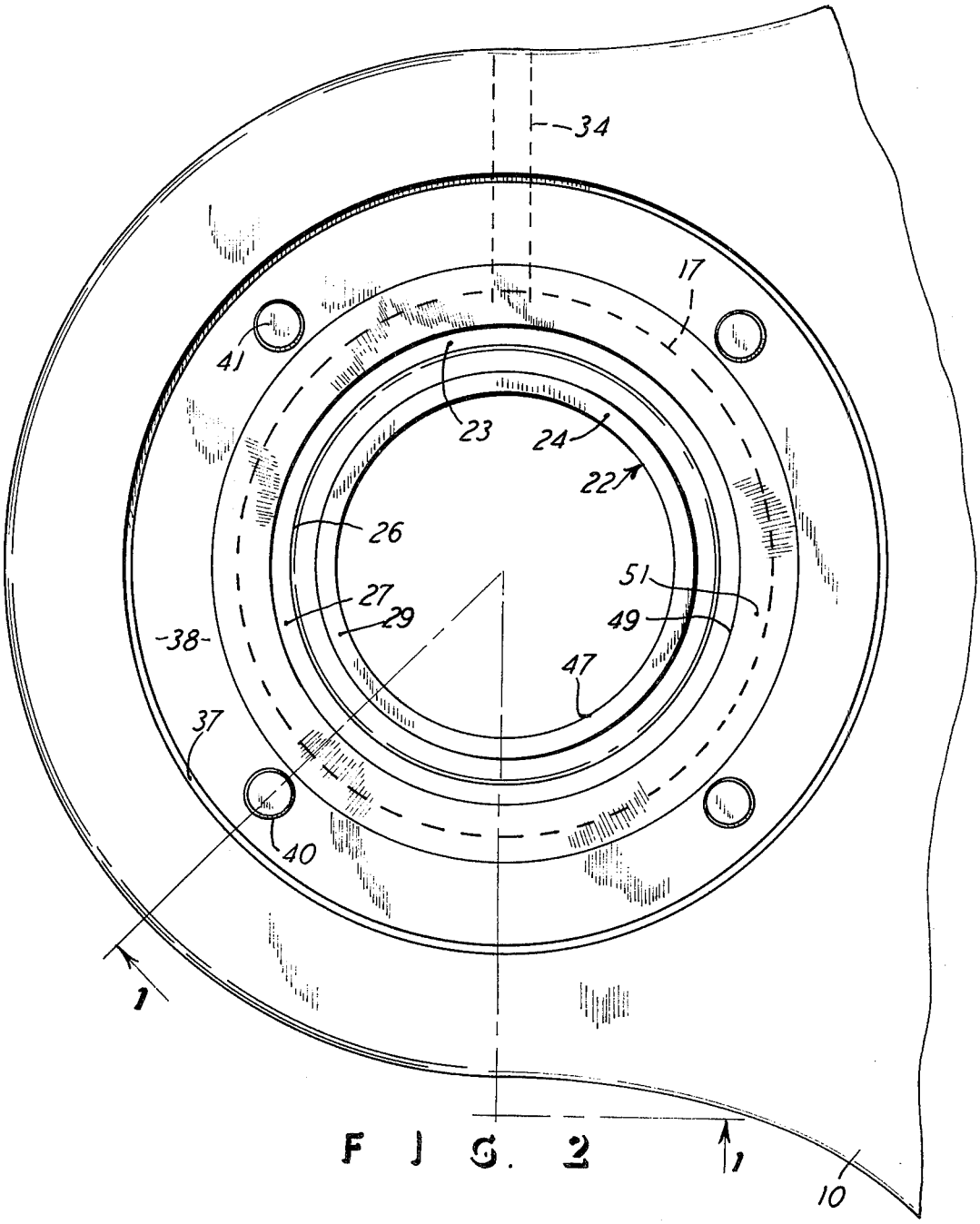
FIG. 2 is a top plan view of the assembly of FIG. 1, with parts removed and with the view being taken along the line 2—2 of FIG. 1.

The drawings show the assembled combination of a tractor-mounted support arm 10 for supporting a bulldozer blade 11 which is shown in FIG. 1 to reveal the blade back portion or surface designated 12. The tractor and blade assembly is like that shown in U.S. Pat. No. 3,645,340 which is incorporated in this disclosure. Thus, the bulldozer blade 11 has two arms 13 welded thereto by weldments 14, and the ears or arms 13 extend rearwardly of the blade 11 and receive a supporting pin or bolt designated 16 such that the pin or bolt 16 is thus fixed relative to the blade 11. Also, the arm 10 extends forwardly of a tractor, as in the said patent, and the arm 10 has a circular opening designated 17 which extends therethrough, and the pin 16 extends through or intersects the opening 17. Of course the pin or bolt 16 is secured by the nut 18, and a cap 19 may also be secured relative to the ears 13 by means of screws 21.

A pivot ball assembly generally designated 22 is interposed between the tractor support arm or member 10 and the blade 11, and thus the blade 11 is articularly or swivelly mounted relative to the arm 10. The assembly 22 consists of an outer race member 23 and an inner race member 24, and the two members are nested together along the spherical surface designated 26, and thus the two members can swivel relative to each other. The drawings further show that the outer race member 23 is cylindrically shaped and is disposed within the opening 17 in the member 10, and the outer race member 23 has two opposite flat and planar end surfaces 27 and 28 at the upper and lower ends, respectively, as shown in FIG. 1. Further, the inner race member 24 has an upper planar surface 29 and a lower planar surface 31, and those surfaces 29 and 31 are parallel to each other and extend beyond the outer race member surfaces 27 and 28, in the neutral or aligned position shown in FIG. 1 of the pivot ball assembly, and thus the inner race member 24 is of an axial length greater than the outer race member 23. Further, the outer diameters of the members 23 and 24 are substantially of the same dimension, and thus only a thin wall designated 32 is required in the outer member 23 in order to provide a secure and steady pivot assembly as shown. Specifically, no bolts or screws or other fasteners need pass through the outer race member 23 which need not therefore be machined for such purpose, because of the general assembly described and shown herein.

Also, a grease groove 33 extends around the surface 26 of the outer race member 23 in order that lubricant is available between the inner and outer race members and at the common surface 26, and a lubricant inlet opening 34 extends through the arm 10 and the outer race member 23 to communicate with the groove 33.

The arm 10 has a shoulder surface 36 extending endlessly in the arm 10 and at the lower end of the opening 17, as seen in FIG. 1. The outer race planar surface 28 is disposed in abuttment with the shoulder surface 36 which therefore retains the outer race 23 relative to the arm 10. Also, the arm 10 has a shoulder and planar surface 37 which is parallel to the surface 36 and which is endless in the arm 10. The surface 37 is disposed to be at a location no higher than the outer race end surface 27, and, more exactly, the surface 37 is on the same plane as the surface 27. A circularly-shaped retainer ring 38 is of an annular shape and has a flat and planar lower surface 39, as seen in FIG. 1, and the surface 39 abuts the surfaces 27 and 37 and also spans those two surfaces, as shown. Thus, the drawings show the annularly-shaped member or ring 38 which abuts the surfaces 27 and 37, and four screws 41 extend through openings 42 in the arm 10 and are threaded and thread into threaded openings 40 in the ring 38 for holding the ring 38 in the snug position shown. The screw heads 50 are concealed in or countersunk in a recess 45 in the arm 10.

With the arrangement described, the screws 41 threadedly engage the ring 38 and pull the ring 38 downwardly, as viewed in FIG. 1, and thus the ring surface 39 is in tight abutment with the outer race surface 27, and thereby the outer race 23 is held in a set position relative to the arm 10. With this arrangement, there need not be any close manufacturing tolerances, compared to those of a snap ring arrangement, and also the pivot ball assembly itself can be disassembled by taking the screws 41 out of their position and thereby removing the ring 38 from the arm 10 and then removing the race assembly designated 22.

A cylindrically-shaped spacing member 43 is disposed adjacent the pivot assembly 22 and is actually in abutment with the surface 29 of the inner race member 24, and the spacing member 43 is also in abutment with the arm 13 and is thus held in a set position. Another cylindrically-shaped spacing member 44 is disposed at the opposite end of the inner race member 24 and is in a set position in the assembly, and thus the inner race member 24 is held in a set position. Further, the pin or bolt member 16 extends snugly through the circular openings 46 and 47 respectively located in the cylindrical spacers and the inner race member 24. Still further, a pliable seal member 48 is disposed at the outer circumference of each spacing member 43 and 44 for keeping the assembly sufficiently clear of external contaminants.

The inner circumference 49 of the retainer ring 38 is spaced from the inner race member 24, as shown in FIG. 1, and, the retainer ring 38 has a tapered surface 51 extending from the inner circumference 49 and outwardly to the radially outer end of the ring member 38. That is, the cross-section of the ring member 38 is less at the radially inner end than it is at the radially outer end where the bolts 41 are located, and thus there is sufficient length in the member 38 for threadedly receiving the bolts 41 in a secure fashion, and there is sufficient stock but yet adaptable stock or material in the ring 38 for bearing against the outer race surface 27. Further, the angulated or tapered surface 51 of the ring 38 is compatible with a tapered surface 52 on the spacing member 43, such that the bulldozer blade 11 can angulate relative to the arm 10, and corresponding swivel movement will be achieved in the pivot ball assembly and particularly in the ring 38, but there will be sufficient clearance between the angulated surfaces 51 and 52, both of which are cylindrical surfaces, to permit the swivel action desired, without interference or limitation of the movement of the ring 38 via the spacing member 43 or any other part in the assembly.

Accordingly, in the assembly described, the arm 10 is provided with the bolt holes 42 and the ring 38 has its aligned and threaded bolt holes 40, and thus the screws 41 need not pass through the swivel assembly 22 itself, and therefore the assembly 22 can be sturdy and need not be specially machined or enlarged for reception of the screws. This means that the hardened material of the assembly 22 can be of a minimum size but need not be machined for receiving screws or bolts or any other fasteners. Also, there are spacers 53 extending in the direction of the bolt 16 which has a shouldering head 54, and thus the bolt 16 cannot be excessively tightened between the ears 13 to distort or bind the entire assembly.

What is claimed is:

1. A pivot ball assembly for use in swivelly attaching a bulldozer blade to a support arm, comprising a support arm having an opening extending therethrough, an assembled pivot ball unit disposed in said opening and having a spherically-shaped inner race member and a flat-ended outer race member with said members being nested together for swivel movement therebetween and with said inner race member having a central axial opening, a pair of spaced-apart ears affixable to the bulldozer blade and having aligned openings therethrough, a threaded attachment pin disposed in said aligned openings and extending between said ears and through said inner race opening, said inner race member having opposite end surfaces respectively spaced from said ears, a plurality of spacing members, each spacing member disposed in abutment with one of said inner race end surfaces and the one of said ears nearest thereto, in addition to said spacing members spacer members, each spacer member disposed respectively between each said spacing member and said attachement pin for limiting the clamping force of said attachment pin on said ears and on said assembled pivot or ball unit, said support arm having a first shoulder surface surrounding said opening therein, said outer race member having its axially opposite end surfaces flat and parallel to each other and with one of said opposite end surfaces being disposed in abutment on said first shoulder surface of said support arm for restricting movement of said outer race member on said support arm and in the direction from said outer race member toward said one of said opposite end surfaces, said support arm having a second shoulder surface disposed countersunk along the plane of the other of said end surfaces of said outer race member and adjacent thereto, a retainer ring having a planar end surface disposed on and spanning said second shoulder surface and said outer race member other end surface for securing said outer race member on said support arm, said support arm having a plurality of holes extending therethrough in the direction perpendicular to the plane defined by each of said shoulder surfaces and intersecting said second shoulder surface, said retainer ring having a plurality of threaded holes axially aligned with said support arm holes, and screws extending through said holes in said support arm and threaded into said retainer ring holes for releasably holding said retainer ring on said support arm.

* * * * *